US007891022B2

(12) United States Patent
Hanada et al.

(10) Patent No.: US 7,891,022 B2
(45) Date of Patent: Feb. 22, 2011

(54) MOISTURE RETENTIVE GLOVES AND PROCESS FOR PRODUCING THE SAME

(75) Inventors: Yasuhiro Hanada, Tokyo (JP); Masaki Oda, Osaka (JP)

(73) Assignee: S.T. Chemical Co., Ltd., Tokyo (JP)

( * ) Notice: Subject to any disclaimer, the term of this patent is extended or adjusted under 35 U.S.C. 154(b) by 1403 days.

(21) Appl. No.: 10/515,309

(22) PCT Filed: Apr. 18, 2003

(86) PCT No.: PCT/JP03/04991

§ 371 (c)(1),
(2), (4) Date: Nov. 22, 2004

(87) PCT Pub. No.: WO2004/002252

PCT Pub. Date: Jan. 8, 2004

(65) Prior Publication Data

US 2005/0183186 A1 Aug. 25, 2005

(30) Foreign Application Priority Data

Jun. 28, 2002 (JP) ..... 2002-189371
Apr. 9, 2003 (JP) ..... 2003-105124

(51) Int. Cl.
*A41D 19/00* (2006.01)
*A41D 19/015* (2006.01)

(52) U.S. Cl. ..... 2/159; 424/400; 424/402; 424/443

(58) Field of Classification Search ..... None
See application file for complete search history.

(56) References Cited

U.S. PATENT DOCUMENTS

| | | | | | |
|---|---|---|---|---|---|
| 2,306,781 | A | * | 12/1942 | Francis, Jr. | 428/198 |
| 3,098,755 | A | * | 7/1963 | Barth et al. | 428/90 |
| 4,122,554 | A | * | 10/1978 | Stager | 2/164 |
| 4,535,121 | A | * | 8/1985 | Oezelli et al. | 524/715 |
| 5,326,567 | A | * | 7/1994 | Capelli | 424/405 |

FOREIGN PATENT DOCUMENTS

| | | | |
|---|---|---|---|
| CN | 1111170 A | | 11/1995 |
| FR | 2 822 711 | | 10/2002 |
| JP | 63-135504 | | 6/1988 |
| JP | 63-102718 | | 7/1988 |
| JP | 63-102719 | | 7/1988 |
| JP | 2-118102 | | 5/1990 |
| JP | 7-26404 | | 1/1995 |
| JP | 8-209448 | | 8/1996 |
| JP | 08209448 | * | 8/1996 |
| JP | 10-183413 | | 7/1998 |
| JP | 2000192326 | * | 12/1998 |
| JP | 11-012822 | | 1/1999 |
| JP | 11-172514 | | 6/1999 |
| JP | 2000-192326 | | 7/2000 |
| JP | 2000-290818 | | 10/2000 |
| JP | 2001-64809 | | 3/2001 |
| JP | 2001-064809 | | 3/2001 |
| JP | 2002-069723 | | 3/2002 |
| JP | 2003-64514 | | 3/2003 |
| JP | 6-220776 | | 8/2008 |

OTHER PUBLICATIONS

Omi Kenshi Co., Ltd. Omi Kenshi ECF Functional Rayon (Papolis) 4pp. www.omikenshi.co.jp and English Translation.

* cited by examiner

*Primary Examiner*—Robert A Wax
*Assistant Examiner*—Melissa S Mercier
(74) *Attorney, Agent, or Firm*—Oblon, Spivak, McClelland, Maier & Neustadt, L.L.P.

(57) ABSTRACT

Moisture retentive gloves characterized by using fibers treated with a moisture retentive component as fibers of an internal surface of gloves fabricated of a rubber or a synthetic resin. In particular, moisture retentive gloves wherein the fibers of an internal surface of gloves are staple fibers bonded to the internal surface of glove base material fabricated of a rubber or a synthetic resin, some or all of the staple fibers treated with a moisture retentive component; and moisture retentive gloves wherein the fibers of an internal surface of gloves are fibers of gloves fabricated of a cloth as a raw material of the gloves, some or all of the fibers constituting the cloth gloves treated with a moisture retentive component.

These moisture retentive gloves, even if used repeated times and used for a prolonged period of time, do not affect the normal bacteria on the skin by virtue of the action of the moisture retentive component retained on the fibers, so that hand skin chapping or the like can be prevented. Further, excellent moisture retentive effects can be exerted thereby.

8 Claims, No Drawings

MOISTURE RETENTIVE GLOVES AND PROCESS FOR PRODUCING THE SAME

TECHNICAL FIELD

The present invention relates to moisture retentive gloves and a process for producing the same. More particularly, the present invention relates to moisture retentive gloves that do not cause chapped skin when used for a prolonged period of time and provide a soft feeling of use, and to a process for producing the moisture retentive gloves.

BACKGROUND ART

Conventionally, gloves for work using water such as cooking and cleaning are made from either rubber such as natural rubber and acrylonitrile-butadiene rubber (NBR) or from soft vinyl chloride resin. To provide ease in application and removal, and to provide warmth during work using water, many gloves comprise staple fibers on the inner surface. In industrial and machinery work, gloves wherein the outer surface of cloth gloves prepared from woven fibers such as cotton are covered with rubber or synthetic resins such as soft vinyl chloride are used. However, after repeated use and prolonged use, moisture resulting from sweat and the like accumulates inside these gloves thereby providing an environment wherein harmful bacteria and mold can easily grow. As a result, problems concerning chapped skin of the hands of the wearer occur.

In order to solve this problem, gloves wherein the glove substrate comprises an antibacterial agent and gloves wherein the inner surface is coated with a pile treated with an antibacterial agent (for example, Japanese Patent Application Laid-open No. 1988-135504), and work gloves wherein a microfiber material is attached to the inside of gloves using an emulsion type adhesive comprising an antibacterial agent (for example, Japanese Utility Model Application Laid-open No. 1988-102719) have been proposed.

However, gloves comprising an antibacterial agent on the glove substrate possess an insufficient antibacterial and anti-molding effect on the inside surface of the gloves. In gloves comprising a pile treated with an antibacterial agent on the inner surface and those comprising a microfiber material attached by an adhesive comprising an antibacterial agent, consideration to the user's hands is insufficient. Specifically, there is a problem wherein the antibacterial agent elutes and kills resident bacteria possessed by the skin. This impairs the prevention effect on the multiplication of harmful bacteria due to the resident bacteria.

Therefore, gloves excelling in moisture retention, which do not affect the resident bacteria of the skin and can prevent chapping of the hands, even if used repeatedly or for a long period of time, have been desired.

DISCLOSURE OF THE INVENTION

As a result of extensive studies to overcome the above problems, the inventors of the present invention have found that gloves possessing an excellent moisture retentive effect and which are gentle on the hands of users having sensitive skin can be obtained by applying fibers treated with a moisture retentive component to the inner surface of the substrate of gloves made of rubber or synthetic resin. This finding has led to the completion of the present invention.

Specifically, the present invention provides moisture retentive gloves characterized by providing fibers treated with a moisture retentive component on the inner surface of gloves made of rubber or synthetic resin.

Furthermore, the present invention provides moisture retentive gloves characterized by providing staple fibers on the inner surface of gloves made of rubber or synthetic resin, wherein at least some portion or all of the staple fibers are treated with a moisture retentive component.

In addition, the present invention provides moisture retentive gloves characterized by providing a layer of rubber or synthetic resin on the outer surface of gloves made of cloth, wherein the cloth gloves are treated with a moisture retentive component.

The present invention also pertains to the method for producing the above moisture retentive gloves.

BEST MODE FOR CARRYING OUT THE INVENTION

The present invention, relating to moisture retentive gloves characterized by having fibers treated with a moisture retention component on the inner surface of the substrate of the gloves made of rubber or synthetic resin, is divided into the two following inventions.

Specifically, one invention relates to moisture retentive gloves characterized by having fibers treated with a moisture retentive component on the inner surface of the gloves made of rubber or synthetic resin (hereinafter, referred to as "first invention"), and the other invention relates to moisture retentive gloves characterized by providing a layer of rubber or synthetic resin on the outer surface of gloves made of cloth, wherein the cloth gloves are treated with a moisture retentive component (hereinafter, referred to as "second invention").

Best modes for carrying out the first invention and the second invention will now be described.

The moisture retentive gloves of the first invention are characterized in that at least some portion or all of the staple fibers adhering to the inner surface of the substrate of the gloves are treated with a moisture retentive component. The term "adhering" in the present specification refers to the condition in which staple fibers are randomly attached to the inner surface of the gloves in order to give a natural feeling.

The substrate of the moisture retentive gloves of the first invention are manufactured from rubber or synthetic resin. Specifically, the gloves are manufactured by a method comprising dipping a glove mold of a known material such as ceramic, metal, glass, or wood in a resin liquid such as latex or a synthetic resin dispersion, and allowing the resin liquid applied to the glove mold to harden.

As examples of the latex used as the resin liquid, natural rubber, synthetic rubbers such as acrylonitrile-butadiene rubber (NBR), chloroprene rubber (CR), styrene-butadiene rubber (SBR), isoprene rubber (IR), and polyurethane (PU), and special rubbers can be given. Even though these rubbers may be used as is, they may also be combined with vulcanizing agents, vulcanizing accelerators, softeners, fillers, and the like.

As examples of the synthetic resin, vinyl chloride resin, acrylic resin, and the like can be given. These synthetic resins may be combined with plasticizers, fillers, and the like. The synthetic resin may be used in the form of a solution or dispersion.

Next, the staple fibers treated with a moisture retentive component will be caused to adhere to the inner surface of the substrate of the above-mentioned gloves.

Either one of natural fibers, synthetic fibers, or chemical fibers, for example, natural fibers such as cotton, wool, and silk, chemical fibers such as rayon, cupra, acetate, and lyocell, and synthetic fibers such as polyethylene, polypropylene, polyester, and nylon, may be used as the staple fibers with no restrictions. Of these, chemical fibers such as rayon and natural fibers such as cotton are preferably used from the viewpoint of ensuring ease in treatment with the moisture retentive component described later.

Staple fibers having a thickness in the range of 0.1-50 dtex, and preferably 0.5-5 dtex can be used. Staple fibers having a length in the range of 0.1-150 mm, and preferably 0.5-3.0 mm can be used.

Any moisture retentive component commonly used in the field of cosmetics and the like may be used in the treatment of the staple fibers without any restrictions. As the moisture retentive component, natural extracts such as squalane, squalene, hyaluronic acid, and chondroitin, propylene glycol, polyethylene glycol, sorbitol, and urea are preferable. These moisture retentive components may be used either individually or in combination of two or more. It is preferable to use squalane in the first invention.

As the method for obtaining staple fibers treated with the above moisture retentive components, methods commonly known can be used. For example, a method of spinning a mixed solution comprising the moisture retentive component as a raw material liquid to obtain fiber incorporating the moisture retentive component, and cutting the fiber to obtain staple fibers, a method of applying the moisture retentive component to conventional fiber by padding, spraying, or impregnation before or after cutting the fiber to form the staple fibers, and the like can be given. When using a chemical fiber such as rayon, from the viewpoint of the effect of durability, the first method such as that disclosed in Japanese Patent Application Laid-open No. 2000-192326 is preferably used. On the other hand, when natural fiber such as cotton is used, the second method is preferable. As the fiber incorporating the moisture retentive component, fibers sold on the market such as Papolis (registered trademark) (rayon incorporating 1.0% squalane, manufactured by Omikenshi Co., Ltd.), cut to form staple fibers can be used.

Even though not limited thereto, the staple fiber treated with a moisture retentive component (hereinafter referred to as "treated staple fiber") comprises the moisture retentive component in an amount of approximately 0.3-30 mass % (hereinafter simply referred to as "%"), and preferably 1-5% of the total amount of the treated staple fiber. If the staple fiber comprises the moisture retentive component in an amount less than 0.3%, the moisture retentive effect may not be displayed. On the other hand, if the amount exceeds 30%, the properties of the fiber worsen and the fiber itself cannot maintain the moisture retentive component and causes the moisture retentive component to deposit on the surface of the fiber, providing an unpleasant feeling during use.

The following are examples of the method for manufacturing the moisture retentive gloves of the first invention.

As the method 1, a method comprising applying the resin liquid to the surface of the glove mold, attaching the treated staple fiber to the surface of the glove while the resin liquid is in a sol or half gel state, and allowing the resin liquid to harden thereby causing the staple fiber to adhere to the surface of the glove can be given.

As the method 2, a method comprising applying the resin liquid to the surface of the glove mold, allowing the resin liquid to harden, applying an adhesive to the hardened surface of the glove substrate, and then causing the treated staple fiber to adhere to the surface can be given.

Of these methods, in the method 1, the glove mold is dipped into the latex or synthetic resin dispersion and removed or the resin liquid is applied to the entire surface of the glove mold by a shower, the treated staple fiber is caused to adhere to the surface of the glove while the rubber or synthetic resin is in a sol or half gel state, and the entire glove mold is heated to harden and mold the rubber or synthetic resin.

In the method 1, to form a glove substrate from rubber, the glove mold is dipped in the latex for approximately 20-60 seconds and the treated staple fiber is caused to adhere to the glove immediately after removing the mold from the latex. Even though drying and crosslinking conditions depend on the type of latex used, generally, a method of completely drying at 80-120° C., followed by heating at 100-130° C. for 20-40 minutes, is preferably used.

Furthermore, to form a glove substrate from a synthetic resin such as polyvinyl chloride, the glove mold is dipped in the dispersed solution for approximately 30-60 seconds and the treated staple fiber is caused to adhere to the glove before heating.

Also, even though gelling conditions differ depending on the type of the synthetic resin component used, heating at a temperature of 200-250° C. for 5-10 minutes is generally preferred.

On the other hand, the manufacturing method 2 comprises applying a resin liquid of latex, synthetic resin dispersion, or the like to the surface of the glove mold, hardening the resin to obtain a glove substrate, applying adhesive to the surface of the glove substrate, then causing the treated staple fibers to adhere to the surface of the glove.

In the manufacturing method 2, the resin is hardened to form the glove substrate in accordance with the above manufacturing method 1.

Even though various types of adhesive may be used in the manufacturing method 2, an adhesive of the same material as that of the glove substrate or having a polarity value close to that of the glove substrate is preferable. Also, when the resin liquid such as latex or synthetic resin dispersion may be used in place of the adhesive, in which case the formed glove substrate that has once been hardened is dipped in the resin-liquid once again, and the staple fibers are caused to adhere, following which the resin is hardened.

The adhesive used in the manufacturing method 2 is preferably combined with an antibacterial agent or anti-molding agent to prevent the growth and reproduction of microorganisms and molds inside the glove, thereby preventing foul odor and discoloration.

As examples of the antibacterial agent and anti-molding agent used, inorganic types such as silver, zeolite, zinc, and copper, imidazole, phenol, bromine, thiazoline, thiazole, carbamate, and sulfamide type antibacterial agents or anti-molding agents can be given.

In both of the above manufacturing methods, as the method for causing the treated staple fibers to adhere to the glove substrate, conventional methods such as a method of placing the treated staple fibers in a sieve and vibrating the sieve to sprinkle the treated staple fibers onto a glove substrate that is in a half-gel or non-crosslinked state, a method using a blower provided with a tank containing the treated staple fibers connected to the intake and causing the blower to suck in pile and blow out the treated staple fibers through a nozzle onto a glove substrate that is in a half-gel or non-crosslinked state, and a method using a blower to blow the treated staple fibers onto a glove substrate that is in a half-gel or non-crosslinked state while using a cyclone to allow the wind to escape to the outside can be given. Also, when necessary, flocking such as electrostatic flocking using an electrode may be combined with these methods to cause the fibers to adhere. The first invention, in particular, preferably employs the electrostatic flocking method to cause the staple fibers to adhere.

In the moisture retentive gloves of the first invention, even though it is desirable for all the staple fibers adhering to the inner surface of the glove substrate to be treated with the moisture retentive component, the treated staple fibers may be combined with staple fibers that are not treated with a moisture retentive component (hereinafter referred to as "non-treated staple fibers"). Even though there is no specific limitation to the combined ratio of the treated staple fibers and the non-treated staple fibers, the treated staple fibers and non-treated staple fibers are preferably combined at a ratio in the range of 100:0-10:90. The case where less than 10% of all the staple fibers are treated staple fibers is not preferable since a moisture retentive effect may not be displayed.

The amount of the staple fibers adhering to a pair of gloves (right and left) is about 1-20 g, with a range of 5-10 g being particularly preferable.

After causing the treated staple fibers to adhere to the glove substrate and hardening the glove substrate, the glove substrate is inversely removed from the glove mold to obtain a moisture retentive glove comprising treated staple fibers on the inner surface.

In the second invention, on the other hand, the moisture retentive gloves are characterized by providing a layer of rubber or synthetic resin on the outer surface of gloves made of cloth, wherein the cloth gloves are treated with a moisture retentive component.

Materials commonly used for rubber or synthetic resin gloves may be used in the present invention without any limitations. As examples of the rubber (latex) and synthetic resin, those of the first invention can be given. As preferable examples, those of the first invention can also be given.

The cloth gloves used in the present invention are treated with a moisture retentive component. As a method for obtaining the cloth gloves treated with a moisture retentive component, a method of treating cloth gloves manufactured by a conventional method with a moisture retentive component (the first method), and a method of knitting the gloves using a yarn comprising a fiber treated with the moisture retentive component in advance (the second method) can be used.

As the fiber used in the formation of the cloth glove in the first method, any one of natural fibers, synthetic fibers, or chemical fibers may be used without any specific limitations. As examples of the fiber, natural fibers such as cotton, wool, and silk, chemical fibers such as rayon, cupra, acetate, and lyocell, and synthetic fibers such as polyethylene, polypropylene, polyester, and nylon can be given.

Of these, chemical fibers such as rayon and natural fibers such as cotton are preferable in view of ensuring ease in the later described moisture retentive component treatment.

As the method for manufacturing the cloth glove, a method comprising knitting the above fibers into a cloth by a conventionally known method, punching out the glove shape from the cloth, and sewing the circumference of the glove, and a method of knitting the above fibers into the shape of a glove using tube knitting (circular knitting) can be given.

Any moisture retentive component commonly used in the field of cosmetics and the like may be used in the treatment of the cloth glove without any restrictions. As examples of this moisture retentive component, those given for the first invention can be given. As preferable examples, those of the first invention can also be given. It is particularly preferable to use squalane in the second invention.

As the method for treating the cloth gloves with the above-mentioned moisture retentive components, a method of applying the moisture retentive component to previously made gloves by patting, spraying, or the like can be used.

On the other hand, as the second method, a method wherein the glove is manufactured by knitting using a yarn comprising fiber that has been previously treated with a moisture retentive component by patting, spraying, or the like can be given. Also, a glove can be obtained by knitting using a fiber obtained by spinning a raw material solution combined with a moisture retentive component. There are no specific limitations to the fiber used in this instance. As specific examples of the fiber used, those mentioned above can be given. There are also no specific limitations to the moisture retentive component. As preferable and particularly preferable examples, those mentioned for the first invention can be given.

When a chemical fiber such as rayon is used in the manufacture of the glove, from the viewpoint of durability of the effect, the second method is preferable for example, the method disclosed in Japanese Patent Application Laid-open No. 2000-192326 can be used. On the other hand, when a natural fiber such as cotton is used, the first method is preferable.

As the fiber incorporating the moisture retentive component, fibers sold on the market such as Papolis (rayon incorporating squalane, manufactured by Omikenshi Co., Ltd.) can be used to manufacture the cloth glove.

When using the second method for manufacturing the cloth glove, even though it is preferable for all the fibers to be treated with a moisture retentive component (hereinafter, referred to as "treated fibers"), these treated fibers may be combined with fibers that are not treated with a moisture retentive component (hereinafter, referred to as "non-treated fibers"). Even though there is no specific limitation to the combined ratio of the treated fibers and the non-treated fibers, the treated fibers and non-treated fibers are preferably combined at a ratio in the range of 100:0-10:90. The ratio is particularly preferably in the range of 100:0-30:70. The case where less than 10% of all the fibers are treated fibers is not preferable since a moisture retentive effect may not be displayed.

Even though not limited thereto, the cloth glove treated with a moisture retentive component (hereinafter referred to as "treated cloth glove") comprises the moisture retentive component in an amount of approximately 0.3-30 mass % (hereinafter simply referred to as "%"), and preferably 1-5% of the entire treated cloth glove. If the cloth glove comprises the moisture retentive component in an amount less than 0.3%, the moisture retentive effect may not be displayed. On the other hand, if the amount exceeds 30%, the properties of the fiber worsen and the fiber itself cannot maintain the moisture retentive component and causes the moisture retentive component to deposit on the surface of the glove, providing an unpleasant feeling during use.

There are no restrictions to the method of manufacturing the moisture retentive glove of the present invention. A method comprising affixing the treated cloth glove to a glove mold, applying a resin liquid to the outer surface of the glove, followed by hardening is preferable.

More specifically, a method comprising affixing the treated cloth glove to a conventional glove mold made of ceramic, metal, glass, or wood, applying latex or synthetic resin dispersion or the like to the outer surface of the glove by dipping or spraying, followed by hardening the applied resin liquid, can be given.

Even more specifically, when rubber is used as the resin liquid, the treated cloth glove is preferably dipped into latex for approximately 20-60 seconds and, though the drying and crosslinking conditions depend on the type of latex used, the resin liquid is generally completely dried at 80-120° C. followed by heating at 100-130° C. for approximately 20-40 minutes.

Furthermore, when the synthetic resin such as a polyvinyl chloride is used, the treated cloth glove is preferably dipped into synthetic resin dispersion for 30-60 seconds and, though the gelling conditions depend on the type of synthetic resin used, is generally heated at 200-250° C. for 5-10 minutes.

After applying and hardening the resin liquid, each treated cloth glove is removed from the glove mold to obtain the moisture retentive gloves of the present invention.

The moisture retentive gloves obtained in the present invention, when used for a prolonged period of time, possess an excellent moisture retentive effect, provide the hands with a moist feeling, can prevent chapped skin on the hands of the user, and provide a supple feeling of use.

EXAMPLES

The present invention will be described in more detail with reference to Examples which should not be construed as limiting the present invention.

Manufacture Example 1

Preparation of the Staple Fiber Treated with the Moisture Retentive Component Rayon fiber prepared in accordance with the description of the Examples of Japanese Patent Publication Laid-open No. 2000-192326 was spun into the form of a tow (fiber bundle) using 1.0% of squalane as a moisture retentive component. The tow was desulfurized, bleached, and washed with water. Next, the tow was cut, refined, treated by electro-deposition, and dried using a conventional method to obtain squalane treated staple fibers having a length of 0.5-0.8 mm and a thickness of 1.1-2.2 dtex (manufactured product 1).

Manufacture Example 2

Preparation of the Non-Treated Staple Fiber

Untreated staple fibers having a length of 0.5-0.8 mm and a thickness of 1.1-2.2 dtex (manufactured product 2) were obtained in the same manner as in Manufacture Example 1, with the exception of not using the moisture retentive component squalane.

Example 1

Preparation of Vinyl Chloride Glove

Present Invention Product 1

A ceramic glove mold was dipped into a vinyl chloride paste having the composition given below. The mold was removed from the paste at a rate that prevented the sol from dripping in order to cover the surface of the glove mold with vinyl chloride sol. Next, the glove mold covered with the sol was heated in an oven at 200-230° C. for approximately 1-3 minutes to convert the sol into a half-gel state.

The half-gel glove substrate was dipped into an acrylic adhesive solution for approximately 10 seconds and removed. Next, using a conventional static flocking method, staple fibers (a homogeneous mixture of manufacture product 1 and manufactured product 2 at a ratio of 30:70) discharged from a nozzle using a blower were caused to adhere to the glove substrate while rotating the mold. The amount of staple fibers adhering was 6 g for a pair of gloves. Next, after heating at 200-230° C. for 5-8 minutes to completely gel the glove substrate, the glove substrate was removed from the mold inversely to obtain a vinyl chloride glove (present invention product 1).

| <Vinyl chloride paste composition> | |
|---|---|
| (Component) | (parts by weight) |
| Vinyl chloride resin | 100 |
| Plasticizer (dioctylphthalate) | 100 |
| Stabilizer (SC-1072 (manufactured by Asahi Denka Co., Ltd.)) | 3 |

Example 2

Preparation of NBR Glove

Present Invention Product 2

(1) Preparation of Dispersion Solution

A dispersion solution was prepared by dispersing the following solutions A and B (mass ratio: 1:1) in a ball mill for approximately 24-48 hours.

| (Component) | (parts by weight) |
|---|---|
| <Solution A> | |
| Casein | 5 |
| 25% ammonia water | 2 |
| Water | 73 |
| <Solution B> | |
| Colloidal sulfur | 20 |
| No. 1 zinc oxide | 40 |
| Vulcanizing accelerator*1 | 10 |
| Surfactant*2 | 50 |
| Water | 100 |

*1zinc dibutyldithiocarbamate
*2sodium dodecylbenzenesulfonate (2) Preparation of NBR Latex Mixed Solution The NBR latex, a dispersant, the dispersion solution prepared in (1) above, and water in the amounts shown below were mixed by sufficient stirring to obtain the NBR latex mixed solution.

| <Composition of NBR latex mixed solution> | |
|---|---|
| (Component) | (parts by weight) |
| NBR latex | 100 |
| Dispersant*3 | 1 |
| Dispersion solution prepared in (1) | 10 |
| Water | 100 |

*3polycarboxylate polymer surfactant (3) Preparation of NBR Glove

A ceramic glove mold was dipped into a 35% calcium nitrate aqueous solution and removed. The ceramic mold was then dipped into the NBR latex solution prepared in (2) above and removed to cover the mold with the latex solution. Next, after treating in 30-70° C. hot water for 5-10 minutes in order to remove excess calcium nitrate and surplus rubber components, the mold was dipped in an acrylic adhesive solution for approximately 10 seconds. Next, using a conventional static flocking method, staple fibers (a homogeneous mixture of manufacture product 1 and manufactured product 2 at a ratio of 30:70) discharged from a nozzle using a blower were caused to adhere to the glove substrate while rotating the mold. The amount of staple fibers attached was 6 g for a pair of gloves. Next, after drying and curing at about 100-130° C. for 30-90 minutes and cooling, the glove substrate was inversely removed from the glove mold to obtain the NBR glove (present invention product 2).

Comparative Example 1

Preparation of Vinyl Chloride Glove

A vinyl chloride glove (comparative product 1) was prepared in accordance with the manufacture method of Example 1 except for using only manufactured product 2 in place of the mixture of the manufactured product 1 and manufactured product 2.

Comparative Example 2

Preparation of NBR Glove

An NBR glove (comparative product 2) was prepared in accordance with the manufacture method of Example 2 except for using only manufactured product 2 in place of the mixture of the manufactured product 1 and manufactured product 2.

Manufacture Example 3

Preparation of Fiber Treated with the Moisture Retentive Component

Rayon fiber prepared in accordance with the description of the Examples of Japanese Patent Publication Laid-open No. 2000-192326, containing 1.0% of squalane as a moisture retentive component, was spun into a tow (fiber bundle). The obtained tow was desulfurized, bleached, and washed with water to obtain squalane treated fiber.

Manufacture Example 4

Preparation of Non-Treated Fiber

Non-treated fibers were obtained in the same manner as in Manufacture Example 3, except for not using the moisture retentive component squalane.

Manufacture Example 5

Preparation of Treated Cloth Glove

A cloth glove was prepared using the squalane treated fiber obtained in Manufacture Example 3 and the non-treated fiber obtained in Manufacture Example 4. Cloth was prepared by knitting using 2 single yarns of the non-treated fiber and 1 single yarn of the treated fiber. The prepared cloth was punched in the shape of a glove, two of the punched sheets of glove cloth were layered, and the periphery was sewn together to obtain a treated cloth glove.

Example 3

Preparation of Vinyl Chloride Glove

Present Invention Product 3

The glove obtained in Manufacture Example 5 was mounted on a metal glove mold, vinyl chloride paste prepared in accordance with Example 1 was uniformly applied to the glove by a shower, and the glove was removed at a speed to prevent dripping of the sol to cover the surface of the glove with vinyl chloride sol. Next, after completely gelling the entire glove by heating in an oven at 200-230° C. for 5-7 minutes, the glove was removed from the mold to obtain the moisture retentive glove of the present invention product 3.

Example 4

Preparation of NBR Glove

Present Invention Product 4

The glove obtained in Manufacture Example 5 was mounted on a metal glove mold. Next, after dipping the glove mold into a 35% calcium nitrate aqueous solution and removing, the mold was dipped into an NBR latex mixed solution prepared in accordance with (2) of Example 2 and removed to cover the mold with latex solution. Next, after treating in 30-70° C. hot water for 5-10 minutes to remove excess calcium nitrate and surplus rubber components, the glove substrate was dried and cured at 100-130° C. for 30-90 minutes, cooled, and removed from the glove mold to obtain the moisture retentive glove of the present invention product 4.

Comparative Example 3

Preparation of Vinyl Chloride Glove

Comparative Product 3

A vinyl chloride glove (comparative product 3) was obtained in the same manner as in Example 3 except for using a cloth glove made from only fibers not treated with moisture retentive component.

Comparative Example 4

Preparation of NBR Glove

Comparative Product 4

An NBR glove (comparative product 4) was obtained in the same manner as in Example 4 except for using a cloth glove made from only fibers not treated with moisture retentive component.

Experiment Example

The present invention products 1-4 and comparative products 1-4 obtained above were used by panelists for a period of one month. Moisture of the hands (degree of moisture retention) and suppleness of the gloves were graded in accordance with the following evaluation criteria. The results are shown in Table 1.

(Evaluation Criteria for Degree of Moisture Retention)

Evaluation: Explanation

X: hands are not moist

Δ: hands are somewhat moist

○: hands are moist (Evaluation Criteria for Suppleness)

Evaluation: Explanation

X: hard

Δ: somewhat hard

○: soft

TABLE 1

| | Product of the present invention | | | | Comparative product | | | |
|---|---|---|---|---|---|---|---|---|
| | 1 | 2 | 3 | 4 | 1 | 2 | 3 | 4 |
| Moisture retention | ○ | ○ | ○ | ○ | X | X | X | X |
| Suppleness | ○ | ○ | ○ | ○ | Δ | Δ | Δ | ○ |

As is clear from the results of Table 1, the products of the present invention possess a superior degree of moisture retention and suppleness when compared with the comparative products, which confirms that the gloves of the present invention possesses excellent moisture retention effect and feeling of use.

INDUSTRIAL APPLICABILITY

Since the moisture retentive gloves of the present invention possess fibers treated with a moisture retentive component on the inner surface of rubber or synthetic resin glove substrate, rubber or synthetic resin gloves possessing an excellent moisture retention effect which moisten the hands, prevent chapping of the hands, and provide a supple feeling of use can be provided.

Also, when the adhesive used to attach the staple fibers possesses an antibacterial agent or anti-mold agent, the growth of microorganisms and mold and the production of a foul odor inside the gloves can be prevented without affecting resident bacteria on the skin.

Therefore, the moisture retentive gloves of the present invention can be effectively used as rubber or synthetic resin gloves for household, medical operations, industrial work, food industry, fishing industry, and other applications.

The invention claimed is:

1. A moisture retentive glove, comprising:

an inner surface comprising electrostatically flocked staple fibers; and an outer layer of rubber or synthetic resin, wherein the electrostatically flocked staple fibers incorporate at least one moisture retentive component, and the staple fibers are obtained by cutting fibers produced by spinning a solution containing the at least one moisture retentive component, resulting in a fiber having the at least one moisture retentive component homogeneously incorporated in the fiber.

2. A moisture retentive glove, comprising:

an inner surface comprising electrostatically flocked rayon staple fibers; and an outer layer of rubber or synthetic resin, wherein the electrostatically flocked rayon staple fibers incorporate at least one moisture retentive component, and the rayon staple fibers are obtained by cutting rayon fibers produced by spinning a solution containing the at least one moisture retentive component, resulting in a rayon fiber having the at least one moisture retentive component homogeneously incorporated in the fiber.

3. The moisture retentive glove according to claim 2, wherein the at least one moisture retentive component is at least one selected from the group consisting of squalane, squalene, hyaluronic acid, propylene glycol, polyethylene glycol, sorbital, urea, and chondroitin.

4. The moisture retentive gloves according to claim 1, wherein 10-100% of the staple fibers provided on the inner surface are treated with a moisture retentive component.

5. The moisture retentive gloves according to claim 1, wherein the at least one moisture retentive component is at least one selected from the group consisting of squalane, squalene, hyaluronic acid, propylene glycol, polyethylene glycol, sorbital, urea, and chondroitin.

6. A method for manufacturing the moisture retentive gloves according to claim 1, comprising:

applying a resin liquid to the surface of a glove mold;

causing the resin liquid to harden to form a glove substrate;

applying an adhesive to the glove substrate; and causing staple fibers comprising staple fibers obtained by cutting fibers produced by spinning a solution containing the at least one moisture retentive component to adhere to the glove substrate by electrostatic flocking.

7. The method for manufacturing moisture retentive gloves according to claim 6, wherein the resin liquid is a rubber latex or a synthetic resin sol.

8. The method for manufacturing moisture retentive gloves according to claim 6, wherein the at least one moisture retentive component is at least one selected from the group consisting of squalane, squalene, hyaluronic acid, propylene glycol, polyethylene glycol, sorbital, urea, and chondroitin.

* * * * *